United States Patent [19]

Nelson, Jr.

[11] 4,007,812

[45] Feb. 15, 1977

[54] ELEVATOR SYSTEM

[75] Inventor: Clarence W. Nelson, Jr., Park Ridge, N.J.

[73] Assignee: Westinghouse Electric Corporation, Pittsburgh, Pa.

[22] Filed: July 7, 1975

[21] Appl. No.: 593,815

[52] U.S. Cl. ..... 187/29 R

[51] Int. Cl.[2] ..... B66B 1/18

[58] Field of Search ..... 187/29

[56] References Cited

UNITED STATES PATENTS

| | | | |
|---|---|---|---|
| 3,504,771 | 4/1970 | Suozzo et al. | 187/29 |
| 3,511,342 | 5/1970 | Hall et al. | 187/29 |
| 3,572,470 | 3/1971 | Hirsch et al. | 187/29 |
| 3,587,786 | 6/1971 | Savino | 187/29 |
| 3,614,995 | 10/1971 | Probert et al. | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

A zoned demand elevator system in which elevator cars are associated with the zone in which they become available for assignment. Each zone has a plurality of graded assignment levels, with an available car entering the highest vacant assignment level of the associated zone. Available cars in predetermined eligible assignment levels of all of the zones are considered when an available car is to be assigned to a demand for elevator service. The order in which the various eligible assignment levels of the zones are considered is determined by the nature of the demand. When an available car is assigned to a demand, available cars, if any, in lower graded assignment levels of that zone advance one assignment level, and an undesignated available car waiting for a graded assignment level to be vacated is given a graded assignment level designation.

11 Claims, 9 Drawing Figures

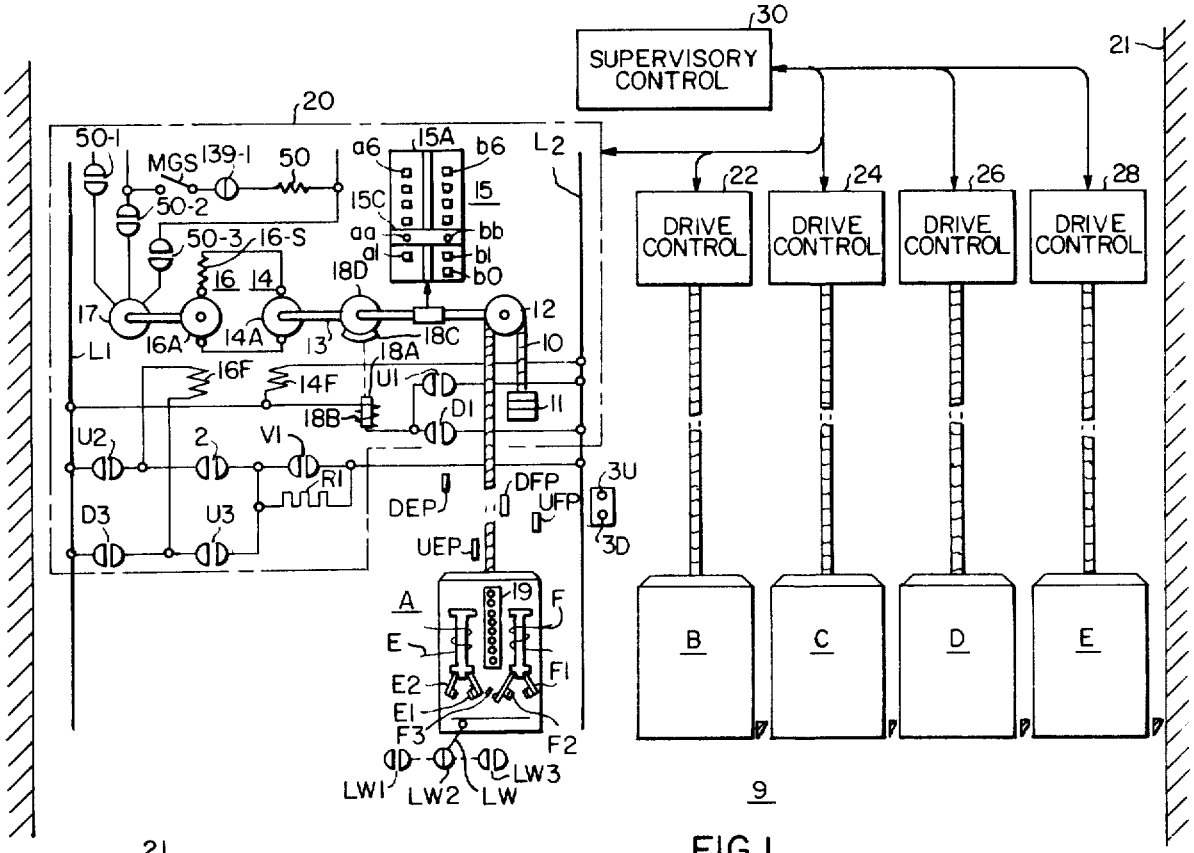
FIG.1
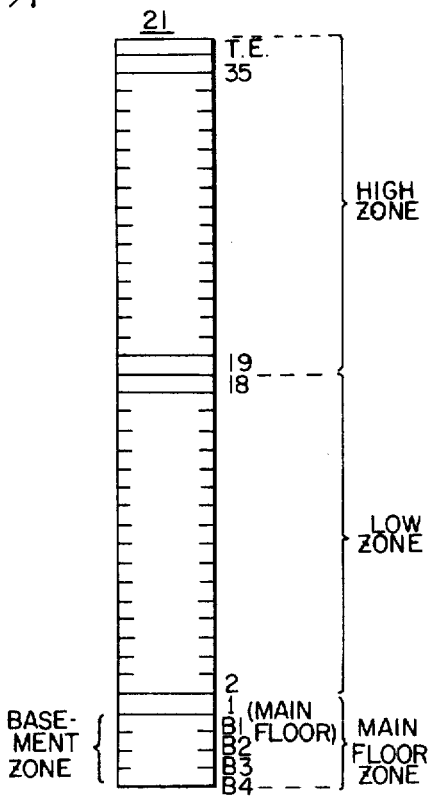
FIG.2
| AV CARS | MAIN FLOOR ZONE | | LOW ZONE | | HIGH ZONE | |
|---|---|---|---|---|---|---|
| | 4 CAR SYSTEM | 5 CAR SYSTEM | 4 CARS | 5 CARS | 4 CARS | 5 CARS |
| 1 ST CAR | AN | AN | ALZ | ALZ | AHZ | AHZ |
| 2 ND CAR | ANN | ANN | ANL | ANL | ANH | ANH |
| 3 RD CAR | AV | AV | AV | AV | AV | AV |
| 4 TH CAR | P→AHZ | AV | 87→AN | AV | 87→AN | AV |
| 5 TH CAR | | P→AHZ | | 87→AN | | 87→AN |
FIG.3

* TO SIMILAR CONTACTS OF CARS B-E

ELEVATOR SYSTEM

BACKGROUND OF THE INVENTION

1. Field of the Invention

The invention relates in general to elevator systems, and more specifically to new and improved zoned demand elevator supervisory systems.

2. Description of the Prior Art

Zoned demand elevator systems, such as the elevator system disclosed in U.S. Pat. No. 3,256,958, which is assigned to the same assignee as the present application, provide highly efficient elevator service by attempting to serve a new hall call with a suitably conditioned busy elevator car and if the hall call cannot be so allocated to a busy car, a demand is registered for an available car. When a busy elevator car completes its assigned tasks, and has no car calls or hall calls ahead of its travel direction, it becomes available for assignment at the floor of its last stop. When a demand for an available car is registered, the closest available car to the floor of the building which initiated the demand is given the assignment.

The zoned demand elevator system of the hereinbefore mentioned U.S. Pat. No. 3,256,958 is especially well suited for large banks of high speed elevator cars in high rise buildings, and the system is extremely flexible in order to accommodate the wide variations in traffic demands associated with such a structure.

In order to extend the zoned demand concept to smaller banks of elevator cars in a low rise building, or in a building with moderate traffic demands, where cost considerations do not justify the sophistication of the system provided by the aforesaid U.S. patent, the system disclosed in U.S. Pat. No. 3,504,771 was developed, which patent is also assigned to the same assignee as the present application. The system disclosed in U.S. Pat. No. 3,504,771 is most advantageous for banks of cars up to and including three elevator cars. The building is divided by the supervisory control into two zones of floors in addition to a main floor and basement. When a car becomes available, it is identified as being available for a specific zone, which may or may not be the zone in which it is physically located, and the zone for which the car is available can be changed as circumstances change.

The zoned demand system of U.S. Pat. No. 3,504,771 has been very successful in providing efficient elevator service for low rise buildings, and does so at a lower cost than would be incurred by using the more sophisticated, more flexible zoned demand supervisory systems developed primarily for high rise, high speed elevator banks.

There are many low rise buildings which require a bank of four or five elevator cars, and the supervisory systems for such as installation do not require the flexibility essential in elevator systems for high rise buildings. Thus it would be desirable to provide a new and improved zoned demand supervisory elevator system capable of efficiently handling four or five cars in a building having up to a maximum of about forty floors, which system should be less costly than the highly flexible high rise supervisory systems, but it should provide excellent service for low rise buildings.

SUMMARY OF THE INVENTION

Briefly, the present invention is a new and improved zoned demand elevator supervisory system suitable for a bank of four cars, and for a bank of five cars. The supervisory control divides the floors of the building into three zones, two of which are located above the main floor, designated the high and low zones, and the third of which includes the main floor and all floors, i.e. basement levels, below the main floor.

The elevator cars, when not busy serving a call for elevator service, are conditioned to become available for assignment in the zone in which they are located. Each zone has a plurality of graded assignment levels associated therewith, with a car entering the highest vacant assignment level of the associated zone when it becomes available, and with an available car in a lower graded assignment level advancing when a higher assignment level becomes vacant. A car must be physically located in a zone before it is identified as being available for that zone. When a call for elevator service cannot be answered by a suitably conditioned busy car, a demand for an available car is created, and an available car is selected to satisfy a demand from predetermined assignment levels of the zones, with the selection order from the zones and assignment levels thereof being responsive to the nature of the demand. In a preferred embodiment, assignments are made only from two graded assignment levels of each zone, with available cars which are not in these eligible levels advancing thereto as assignments are made from these levels.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 1 is a schematic diagram of an elevator system which may be constructed according to the teachings of the invention;

FIG. 2 is a diagram which illustrates the building shown in FIG. 1, and how the building is zoned by the supervisory control;

FIG. 3 is a chart which illustrates the assignment levels of each building zone, for a four car system, and for a five car system; and, FIGS. 4 through 9 are schematic diagrams of supervisory control constructed according to the teachings of the invention, which may be used for the supervisory control shown in block form in FIG. 1.

DESCRIPTION OF PREFERRED EMBODIMENTS

Figure 4:
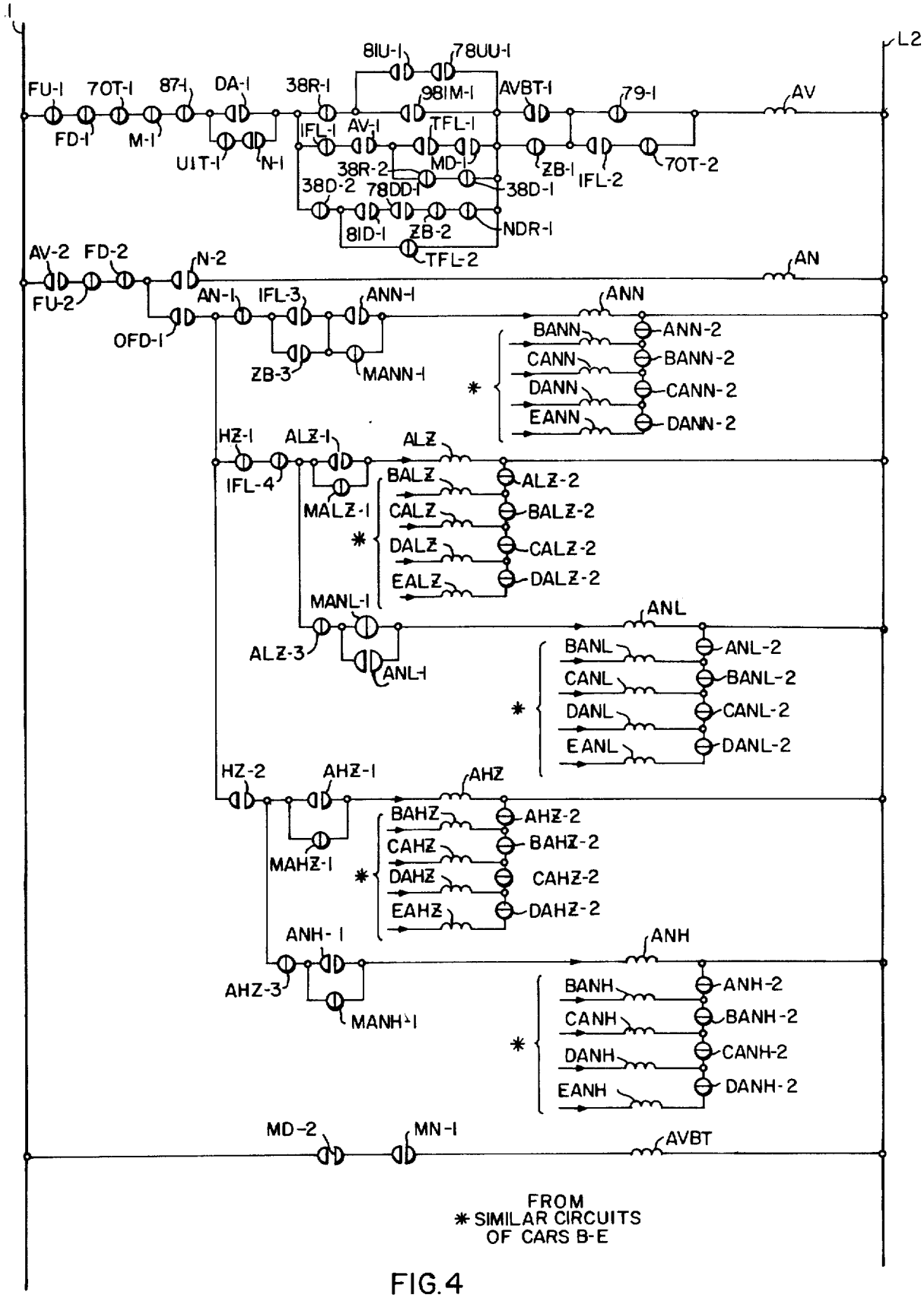

The hereinbefore mentioned U.S. Pat. Nos. 3,256,958 and 3,504,771 describe modern zoned demand elevator systems in great detail, and thus only those portions of an elevator system which are necessary to understand the present invention are included in the present application. The subject matter of U.S. Pat. No. 3,256,958 and 3,504,771 is hereby incorporated into the present application by reference, and in order to facilitate reference to these patents, relay designations for like functions have been maintained. U.S. Pat. Nos. 3,256,958 and 3,504,771 will hereinafter be referred to as the first and second incorporated patents, respectively.

Referring now to the drawings, and to FIG. 1 in particular, there is shown an elevator system 9 which may be constructed according to the teachings of the invention. Elevator system 9 is most advantageously applied to four and five car elevator banks, and is illustrated in FIG. 1 with five cars, referred to as cars A through E, which are mounted for movement in a building 21 to serve the floors therein. The motor or drive control 20, 22, 24, 26 and 28 for cars A through E, respectively, may be of similar construction, and thus only the drive control 20 for car A is shown in detail.

Control 20 includes a motor 14 which, for purposes of example, is assumed to be a direct current motor which may be provided with an adjustable direct current voltage by a D.C. generator 16 driven by a motor 17; or, the motor 14 may be provided with an adjustable direct current voltage from a solid state direct current power supply, as desired.

More specifically, elevator car A is connected by a rope or cable 10 to a counterweight 11. The rope 10 passes over a sheave 12, which is secured to a shaft 13 for rotation therewith. The shaft 13 is rotated by the drive motor 14. Motor 14 includes an armature 14A secured to the shaft 13 and having a field winding 14F, which is permanently connected across two direct current buses L1 and L2, which supply direct current energy for the control circuits.

The elevator car A has therein a plurality of normally open car call pushbuttons 19, which are actuated for the purpose of registering calls for the floors desired by passengers entering the elevator car.

To permit registration of calls for service by prospective passengers located at the various floors served by the elevator cars, pushbutton stations are located at such floors. Such a station is shown in FIG. 1 for the third floor. It includes a normally open up floor call pushbutton 3U, which is pressed by a prospective passenger desiring elevator service in the up direction. A similar pushbutton is located at each floor from which service in the up direction may be desired. The station also includes a normally open pushbutton 3D, which is pressed by a prospective passenger desiring elevator service in the down direction. A similar pushbutton is located at each floor from which elevator service in the down direction may be desired. The numeral of each reference character (as 3D or 3U) indicates the floor at which the pushbutton is located.

The elevator car A also has mounted thereon an inductor slowdown relay E and an inductor stopping relay F which may be of conventional construction. The slowdown relay E has two sets of break contacts E1 and E2 associated therewith. The relay has a normally incomplete magnetic circuit, and energization of the winding of the relay alone does not affect the associated contacts. However, if the slowdown relay E, when its winding is energized, reaches an up inductor plate UEP located in the hoistway of the elevator car, the contacts E1 open. In FIG. 1 the inductor plate UEP is assumed to be mounted in the hoistway to be reached by the slowdown relay E as the elevator car A nears the third floor. If the elevator car A is to stop at the third floor, the winding of the relay E is energized; and when the relay reaches the inductor plate UEP for the third floor, the contacts E1 open to initiate a slowdown operation of the elevator car. It will be understood that a similar inductor plate is similarly associated with each of the floors at which the elevator car A may stop during up travel thereof.

During down travel of the elevator car A, the inductor slowdown relay E cooperates with down inductor plates DEP to initiate a slowdown operation of the elevator car as it approaches a floor at which the elevator car is intended to stop. For example, if the elevator car is to stop during down travel at the third floor, the winding of the inductor relay E is energized as the elevator car nears the third floor. When the inductor relay reaches the down inductor plate DEP for the third floor, the break contacts E2 open to initiate a slowdown operation of the elevator car. It will be understood that a similar inductor plate DEP is provided for each of the floors at which the elevator car A is to stop during down travel thereof.

The inductor stopping relay F similarly cooperates with inductor plates UFP and DFP for the purpose of bringing the elevator car to a stop as it reaches a floor at which it is to stop. Thus, if the elevator car A during up travel is to stop at the third floor, the winding of the stopping relay F is energized; and as the stopping relay F reaches the stopping inductor plate UFP for the third floor, its break contacts F1 open. These contacts in opening effect the stopping of the elevator car at the third floor. A similar inductor plate is provided at each of the floors at which the elevator car A is to stop during up travel thereof.

If the elevator car A is to stop at the third floor during down travel thereof, the winding of the inductor stopping relay F is energized; and as the relay reaches the inductor plate DFP for the third floor, its break contacts F2 open to produce a stopping operation of the elevator car at the third floor. At the same time, make contacts F3 close for a purpose pointed out below. It will be understood that a similar inductor plate is provided for each of the floors at which the elevator car A is to stop during down travel thereof.

When the elevator car A is loaded to capacity, a load switch LW is operated to close its make contacts LW1 and LW3 and to open its break contact LW2. Such load switches are well known in the art.

Because of the large number of control circuits required, it is conventional practice to provide each elevator car with a floor selector. The selector 15 for the elevator car A includes a plurality of rows of contact segments mounted on an insulating panel 15A. Only two rows of contact segments *a*1 through *a*6 and *b*0 through *b*6 are illustrated in FIG. 1. These contact segments are successively engaged during travel of the elevator car respectively by brushes *aa* and *bb* for the purpose of controlling the energization of certain circuits. For example, if the elevator car A during up travel is to stop at the third floor in response to an up floor call, the brush aa engages the contact segment *a*3 shortly before the elevator car A reaches the third floor to initate a stopping operation thereof.

The brushes *aa* and *bb* are mounted on a brush carriage 15C, which is mounted for reciprocation in accordance with movement of the elevator car. Consequently, as the elevator car A moves, the brushes mounted on the carriage 15C permit the energization of appropriate circuits at various points of travel of the elevator car. Additional floor selector contact segments and brushes are also provided but are not illustrated in FIG. 1. The arrangement of these contact segments and brushes will be understood from the preceding discussion.

The floor selector 15 may be of any conventional type. For example, the carriage 15C thereof may be disposed for movement in synchronism with movement of the elevator car A, but at a greatly reduced rate. Or the carriage may notch rapidly in discrete stops in advance of the car as the car moves from floor to floor. In the present instance, it will be assumed that the floor selector is of the latter type.

Although the driving motor 14 may be energized in various ways, it will be assumed that the control of this motor is of the type commonly referred to as a variable voltage control. In such a control, a direct current generator 16 has its armature 16A connected in a loop with the armature 14A of the motor 14. A series field winding 16S for the generator also may be included in this loop. The generator has a main field winding 16F which is connected for energization from the buses L1 and L2 through a reversing switch. This reversing switch includes make contacts U2 and U3 of the up switch U. When these contacts are closed, the field winding is energized with proper polarity for up travel of the elevator car. On the other hand, when make contacts D2 and D3 of the down switch D are closed, the field winding is energized with proper polarity for down travel of the elevator car. The energization of the field winding is completed through a resistor R1 for slow speed operation of the elevator car or through make contacts V1 of a speed relay V for full speed operation of the elevator car.

The armature of the direct current generator 16 is rotated at a constant rate in any suitable manner as by means of a three-phase induction motor 17, which is connected to a suitable three-phase source of energy through make contacts 50-1, 50-2 and 50-3 of the motor-generator starting relay 50. The relay 50, in turn is energized from one phase of this three-phase source through a manually operable switch MGS and break contacts 139-1 of the motor-generator shutdown relay 139. Thus, the motor 17 may be started manually by operation of the switch MGS to its closed condition and thereafter may be stopped and started automatically by operation of the break contacts 139-1.

The elevator car A is provided with a conventional spring-applied electromagnetically released brake. This brake includes a brake drum 18D, which is secured to the shaft 13 for rotation therewith. A brake shoe 18C normally is biased against the brake drum by means of a spring (not shown). The brake is released upon energization of a brake coil 18B, which cooperates with a magnetic armature 18A secured to the shoe 18C. The coil 18B is connected to the buses L1 and L2 for energization either through make contacts U1 or through make contacts D1 of the up switch U or the down switch D, respectively.

The bank of five elevator cars A through E are controlled by supervisory control 30, which directs the answering of calls for elevator service by the elevator cars to provide efficient service for the building 21. The invention is directed to new and improved supervisory control 30, with FIGS. 4 through 9 illustrating detailed control circuits constructed according to the teachings of the invention, which circuits may be used for the supervisory control 30, along with conventional circuits which may be the same as illustrated in the first and second incorporated patents.

In general, the elevator system 9 is a zoned demand system in which the building 21 is divided into groups or zones of floors by the supervisory control 30, with the zone being used by the supervisory control to identify the locations of the elevator car, the locations of calls for elevator service, and the locations of demands for elevator service, wherein a demand indicates a need for locating and assigning an available car to a specific task. The zoning is not as complex or an sophisticated in this application as in the first incorporated patent, nor is such sophistication required, as the zoned demand supervisory control of the present is directed specifically to buildings having a maximum of about forty floor levels.

The zoning arrangement of the present application is illustrated diagrammatically in FIG. 2. The building 21 includes a first floor, which will be referred to as the main floor, a plurality of floors above the main floor which are divided into two zones referred to as the low zone and high zone, and there may be one or more floors or basement levels located below the main floor. The main floor and basement levels provide a third zone, referred to as the main floor zone. For purposes of example, FIG. 2 illustrates a total of forty floors, which include four basement levels B1 through B4, a main floor, and 35 floors above the main floor level, with the top floor being referred to as the top extension. This arrangement represents about the maximum building size suitable for the supervisory control of the present application, and of course it may be advantageously applied to buildings having fewer floors, with and without basement levels or top extension, in any desired combination.

In the specific example for building 21 shown in FIG. 2, the main floor zone includes the main floor and basement levels B1 through B4, the low zone includes floors 2 through 18, and the high zone includes floors 19 through the top extension T.E.

Before describing the circuits of the invention in detail, it will be helpful to list the components of the system which are associated with each elevator car individually, and those components which are common to all of the elevator cars. Substantial portions of the circuits for the cars are identical, and thus only those circuits and components for car A are shown. In those circuits which include components from all of the elevator cars, the designation listed below for car A will be preceded by the letter which identifies the elevator car.

| APPARATUS FOR ELEVATOR CAR A | |
|---|---|
| AHZ | First high zone available car relay |
| ALZ | First low zone available car relay |
| AN | First next available car relay |
| ANH | Second high zone available car relay |
| ANL | Second low zone available car relay |
| ANN | Second next available car relay |
| AV | Available car relay |
| AVBT | Basement available car relay |
| B69 | Bottom floor relay |
| D | Down switch |
| DA | Door relay |
| DBH | Down call behind in high zone relay |
| DBL | Down call behind in low zone relay |
| E | Inductor slow down relay |
| F | Inductor stopping relay |
| FD | Down demand assignment relay |
| FDH | High zone down demand assignment relay |
| FDL | Low zone down demand assignment relay |
| FU | Up demand assignment relay |
| FUH | High zone up demand assignment relay |
| FUL | Low zone up demand assignment relay |
| HZ | High zone relay |
| LW | Load weighing switch |
| M | Running relay |
| M69 | Main floor relay |
| MGS | Motor-generator switch |
| N | Next car relay |
| P | Mid-building park relay |
| SS | Main floor starting relay |
| TFL | Top floor relay |
| U | Up switch |
| UBH | Up call behind in high zone relay |
| UBL | Up call behind in low zone relay |
| V | Speed relay |
| ZB | Basement zone relay |

-continued

| | APPARATUS FOR ELEVATOR CAR A |
|---|---|
| OFL | Basement relay |
| 1FI | Main floor relay |
| 38D | Car call below relay |
| 38R | Car call above relay |
| 42 | Auxiliary door control relay |
| 45 | Door control relay |
| 50 | Motor-generator starting relay |
| 70T | Non-interference relay |
| 78DD | Down call ahead relay |
| 78UU | Up call ahead relay |
| 79 | Basement assignment relay |
| 81 | Auxiliary running relay |
| 81D | Down preference relay |
| 81U | Up preference relay |
| 87 | Main floor assignment relay |
| 89TJ | Motor-generator shut-down timer |
| 139 | Motor-generator shut-down relay |
| 438 | Stopping relay |
| 931M | Car in-service at main floor relay |

| | APPARATUS COMMON TO ALL CARS |
|---|---|
| BDE | Basement demand enable |
| DCH | Down hall call in high zone relay |
| DCL | Down hall call in low zone relay |
| DDH | Down demand in high zone relay |
| DDL | Down demand in low zone relay |
| G40 | Motor-generator to NEXT signal relay |
| MAHZ | Master first high zone available car relay |
| MALZ | Master first low zone available car relay |
| MAN | Master first next available car relay |
| MANH | Master second high zone available car relay |
| MANL | Master second low zone available car relay |
| MANN | Master second next available car relay |
| MD | Master demand relay |
| MFD | Main floor demand relay |
| MN | Master next car relay |
| M79 | Master basement assignment relay |
| M87 | Master main floor assignment relay |
| NDR | No demand return relay |
| PMT | Master parking signal relay |
| UCH | Up call in high zone relay |
| UCL | Up call in low zone relay |
| UDH | Up demand in high zone relay |
| UDL | Up demand in low zone relay |
| U1T | Dispatching interval relay |
| OFD | Basement demand relay |
| OUR | Up hall call relay for basement level |
| 1DR | Down hall call relay for main floor |

FIG. 3 is a chart which is helpful in understanding the operation of the zoned elevator system of the invention. Each of the three zones, i.e. the main floor zone, the low zone, and the high zone, have a plurality of graded assignment levels with which available cars are identified as they become available for assignment in a zone. It is important to note that according to the teachings of the invention, an available car is only given an assignment level designation for the zone in which it is physically located. Further, an available car is only assigned to a demand when the available car is given an assignment level designation. If there are more available cars in a zone than graded assignment levels, the available cars which are not identified with a graded assignment level, are simply referred to as undesignated available cars.

When an elevator car becomes available in a zone it assumes the highest vacant assignment level designation or status, and when an available car from one of the graded assignment level designations is assigned to a demand, an available car in a lower ranked assignment level will move up to take its place, and if there are any undesignated available cars, one of the undesignated available cars will move into the graded assignment level designation.

Referring now to the chart in FIG. 3, with a four car bank, the first car to become available in the main floor zone is given the highest available car status and its relay AN picks up to indicate that it is the first NEXT car, i.e. the car which stands at the main floor with its doors open to accept prospective passengers from the main floor. If the second car becomes available in the main floor zone while the first car is still available at the floor without a main floor start signal from relay SS, it assumes the second graded assignment level status or designation of second NEXT available car, and its relay ANN picks up to indicate that it is the second NEXT available car. Should the first NEXT car receive a signal to start, its AN relay will drop, the ANN relay of the second NEXT available car will drop, and the AN relay of this second NEXT car will pick up, thus moving it to the highest assignment level designation.

If a third car should become available at the main floor while the first two cars are still available in the main floor zone, it is an undesignated available car and is not identified specifically with the zone, and it will not be available for assignment until it moves into one of the designated assignment levels of the main floor zone.

If the fourth car should become available in the main floor zone while the other three cars are still available in the main floor zone, its mid-building park relay P picks up causing the elevator car to travel to the lowest floor of the high zone, i.e. floor 19 of the building 21 illustrated by way of example in FIG. 2. When the elevator car enters the high zone, it becomes the first available car of the high zone and its relay AHZ will pick up to signify that it has this available car assignment designation.

In a five car system, the fourth elevator car to become available in the main floor zone is an undesignated available car, similar to the third car to become available in the zone. If the fifth elevator car becomes available in the main floor zone while the other four cars are still available in the zone, the fifth car receives the parking signal P to park at the lowest floor of the high zone.

The first car to become available in the low zone, in either a four or five car bank, is given the designation as first low zone available car, and its relay ALZ will pick up to signify that this elevator car is so designated. If a second car becomes available in the low zone while the first car is still available in the zone, it will be designated the second low zone available car, and its relay ANL will pick up to indicate that this car has this designation. If a third car becomes available in the low zone while the first two cars are still available in the low zone, it is simply an undesignated available car, in both the four and five car banks. It will move into a designated assignment slot, when one of the available cars in these assignment levels or slots is assigned to a demand.

In a four car system, if the fourth car becomes available in the low zone while the other three cars are available, its 87 relay picks up to give it a main floor assignment, and the car travels to the main floor. When the elevator car reaches the main floor, it becomes the first NEXT available car, and its AN relay picks up to indicate the car has this designation. In a five car bank, the fourth elevator car to become available in the low zone simply becomes an undesignated available car, which like the third car, must move into one of the designated assignment levels in order to receive an assignment. In a five car system, the fifth car to become available in the low zone receives an assignment to travel to the main floor to become the first NEXT available car at the main floor.

The first elevator car to become available in the high zone becomes the first high zone available car and its relay AHZ picks up to indicate that this car is the first high zone available car. If a second car should become available in the high zone while the first car is still available in the zone, it becomes the second high zone available car and its ANH relay picks up to indicate that this car has this designation. If a third car becomes available in the zone, it is an undesignated available car and must wait for a designated assignment level to become vacant, before it will move into the designated status. In a four car bank, if a fourth car should become available in the high zone, its 87 relay picks up to cause it to park at the main floor, and become the first NEXT available car at the main floor. In a five car system, the fourth car to become available in the high zone simply becomes an undesignated available car, similar to the third car to become available in the zone. In a five car elevator bank, should the fifth car become available in the high zone, it will receive the parking signal which causes it to travel to the main floor and become the first NEXT available car at the main floor.

All of the cars do not have to become available in a single zone before the last car becoming available in a zone is given a parking signal to travel to another zone. For example, when there is no NEXT car at the main floor, and a main floor demand is registered, an available car from one of the other two zones is picked for the main floor assignment. Further, when there are no available cars in the high zone, an available car from one of the other two zones is picked to travel to the high zone to become the first high zone available car.

FIG. 4 is a schematic diagram which illustrates the availability circuits for car A, plus those portions of the circuits of cars B through E which are pertinent to the graded assignment levels for the available cars in the various zones.

In general, a car becomes available for assignment to service demands under any of the following conditions:

1. A car while traveling up in the low zone answers its last car call and
   a. there are no up hall calls above the car in the low zone
   b. there are no up hall calls in the high zone.
2. A car while traveling up in the high zone answers its last car call and there are no up hall calls above it.
3. A car while traveling down in the high zone answers its last car call and
   a. there are no down hall calls below the car in the high zone
   b. there are no down hall calls in the low zone
   c. the car has not been assigned to the main floor zone (main floor and basements).
4. A car while traveling down in the low zone answers its last car call and
   a. there are no down hall calls below the car in the low zone
   b. the car has not been assigned to the main floor zone (main floor and basements).
5. A car becomes available when the doors close after a predetermined time, provided no car calls have been registered.
6. A car after answering its last car call in the main floor zone will become available if there are no demands in that zone or elsewhere in the system. If a car becomes available at a basement floor, it will automatically be sent to park at the main floor.

When a car becomes available for assignments to service demands its AV relay is energized. When the elevator car is above the main floor and its travel direction is up, the car can become available for assignment through the following circuit:

L1, FU-1, FD-1, 70T-1, M-1, 87-1, DA-1, 38R-1, 81U-1, 78UU-1, ZB-1, 79-1, AV, L2

Energization of relay AV through this circuit indicates the car has not been assigned to up or down demands (break contacts FU-1 and FD-1 are closed), the door non-interference time has expired (break contact 70T-1 is closed), the car is not running (break contact M-1 is closed), the car does not have a main floor assignment (break contact 87-1 is closed), the doors of the elevator car are closed (make contact DA-1 is closed), there are no car calls for a floor above the car (break contact 38R-1 is closed), the car is set for up travel (make contact 81U-1 is closed), there are no up hall calls ahead of the car (make contact 78UU-1 is closed), the car is not in the basement zone (break contact ZB-1 is closed), and the car does not have a basement assignment (break contact 79-1 is closed). Once the AV relay picks up through this circuit it stays energized until the car is assigned to an up or down demand, i.e. contact FU-1 or contact FD-1 opens, respectively, or the car is given a main floor or basement assignment, i.e. contact 87-1 or contact 79-1 opens, respectively.

When the elevator car is above the main floor and its travel direction is down, it can become available for assignment through the following circuit:

L1, FU-1, FD-1, 70T-1, M-1, 87-1, DA-1, 38D-2, 81D-1, 78DD-1, ZB-2, NDR-1, ZB-1, 79-1, AV, L2

When the elevator car is at the top floor, the top floor relay TFL drops, its contact TFL-2 closes, and the car can become available if it does not have car calls, i.e. contact 38D-2 is closed.

If the car becomes available through one of the hereinbefore mentioned circuits, its contact AV-1 closes, and if the car is above the main floor contact 1FL-1 will be closed, and the car can retain its availability status through one of two circuits, notwithstanding the registration of hall calls ahead, i.e. contact 78UU-1 or contact 78DD-1 opening. The first of these circuits includes contacts 38R-2 and 38D-1, which will be closed to maintain the energization of relay AV when the car does not have any car calls. The second of these circuits includes contacts TFL-1 and MD-1, which are both closed when the car is not at the top floor and there are demands for service in the system.

When the elevator car is at the main floor and it is not NEXT, make contact 981M-1 is closed, bypassing contacts 81U-1 and 78UU-1, and relay AV is energized by the circuit listed above except contacts 81U-1 and 78UU-1 are replaced by contact 981M-1. Once relay AV picks up in this situation, it stays energized until the elevator car is assigned to a service demand, i.e. contact FU-1 or contact FD-1 opens. If the car becomes NEXT, the doors open and contact DA-1 opens to drop relay AV. The closing of contact N-1 when the car becomes NEXT does not re-establish the circuit because the dispatching interval relay UIT-1 is energized. If the dispatching interval expires without a car call being registered in the car, relay UIT-1 drops and the car becomes available, i.e. relay AV picks up through contacts UIT-1 and N-1, even through the doors are open (contact DA-1 is open). If the car is assigned to a service demand or a passenger enters the elevator car and places a car call, relay AV will drop.

Relay AVBT enables a car to become available for assignment when it is in the basement zone (contact ZB-1 in the circuit of relay AV is open) if there is a NEXT car at the main floor (contact MN-1 is closed) and there is a demand in the system (contact MD-2 is closed). Contact AVBT-1 of relay AVBT thus bypasses the open contact ZB-1 and enables the car to become available for assignment.

If a car is available at the main floor with its doors closed and it is given a basement assignment, contact 79-1 opens to drop the AV relay. If no one enters the car and places a car call for a basement floor, the car becomes available again when the non-interference time expires and the doors close (contact 70T-2 and contact DA-1 close).

When a car is available and it is not assigned to demands, contacts AV-2, FU-2 and FD-2 will be closed, enabling the car to enter one of the graded assignment levels, with the specific assignment level depending upon the zone the car is physically located in, and the number of cars which are already available in this zone.

If the car is in the main floor zone and is NEXT, its N relay will be energized and contact N-2 closes to pick up relay AN. When relay AN picks up it indicates the car is available and is the first NEXT available car in the main floor zone.

If car A becomes available at the main floor (contact 1FL-3 closed), or it is in the basement zone (ZB-3 is closed), it is not NEXT (contact AN-1 is closed), there is no basement demand (contact OFD-1 is closed), and no car is designated as the second NEXT available car (contact MANN-1 closed), its relay ANN will pick up and seal in with its contact ANN-1 to indicate that car A is the second NEXT available car at the main floor. Contact ANN-3 of relay ANN closes to pick up the master relay MANN (FIG. 5) and contacts of relay MANN open to prevent any other car from having its ANN relay energized.

When car A becomes NEXT, its contact N-2 will close, relay AN will pick up and its contact AN-1 will open to drop relay ANN. If another car was available at the main floor when the ANN relay for car A drops and its contact ANN-2 closes, its ANN relay will now pick up since the master relay MANN will drop to enable the ANN relays of the other elevator cars. If two cars are available at the main floor when the ANN relay drops, the interlock arrangement provided by contacts ANN-2, BANN-2, CANN-2 and DANN-2 picks up the ANN relay of the car whose letter designation is higher in the alphabet. For example, if cars D and E are both available at the main floor as undesignated available cars when contact ANN-2 closes, relay DANN of car D will pick up and its contact DANN-2 will open to prevent relay EANN from being energized.

If a car becomes available in the low zone, its relay HZ and its first floor relay 1 FL will be deenergized and contacts HZ-1 and 1FL-4 are closed to enable the car to enter an assignment level in the low zone. If the first low zone available car level is vacant, master relay MALZ (FIG. 5) will be deenegized, its contact MALZ-1 in FIG. 4 will be closed, and the ALZ relay of this car will pick up to indicate that is the first low zone available car. Its ALZ relay will seal in with its ALZ-1 contact and energization of the ALZ relay will be unaffected when the master relay MALZ in FIG. 5 picks up through contact ALZ-4 to indicate that there is a first low zone available car.

If a car becomes available in the low zone and it is not the first low zone available car its ALZ-3 contact will be closed to enable its ANL relay. If no other car is the second low zone available car, master relay MANL in FIG. 5 will be deenergized and relay ANL will pick up through contact MANL-1. Relay ANL will seal in through its contact ANL-1, contact ANL-2 opens to isolate the ANL relays of the cars having a lower letter designation, and contact ANL-3 will close to pick up the master relay MANL and prevent the ANL relay of any other car from picking up, regardless of its letter designation.

When the first low zone available car receives an assignment, its ALZ relay drops to drop the master relay MALZ and its ALZ-2 contact closes to enable the ALZ relays of the other elevator cars. If there is still one available car in the low zone, it would be the second low zone available car, and its relay ANL would be energized. However, when relay MALZ drops out, it picks up the ALZ relay of this car and the ALZ-3 contact will open to drop out its ANL relay. If two cars are available in the low zone when the first low zone available car receives an assignment, the interlocking contacts ALZ-2, BALZ-2, CALZ-2 and DALZ-2 pick the available car with the higher letter in the alphabet for the first low zone available car. Thus, if car A was the first low zone available car, car E was the second low zone available car, and car B was also available in the low zone, car B would become the first low zone available car and car E would retain the second low zone available car status.

If the second low zone available car advances to become the first low zone available car, an undesignated available car in the zone would become the second low zone available car. If more than one available car is waiting for advancement to a graded assignment level, the one with the higher letter designation in the alphabet will be selected.

If a car becomes available in the high zone, its HZ relay will be energized which opens its contact HZ-1 to isolate the low zone relays ALZ and ANL, and its contact HZ-2 closes to enable the high zone assignment level relays AHZ and ANH. If no car has the first high zone available car assignment, the master relay MAHZ of FIG. 5 will be deenergized and the ANZ relay of the first car to become available in the high zone will pick up through contact MAHZ-1 and seal in via contact AHZ-1. Contact AHZ-2 isolates the AHZ relays of cars with lower designations in the alphabet and contact AHZ-4 picks up the master relay MAHZ which prevents any other car from having its AHZ relay energized.

Figure 5:
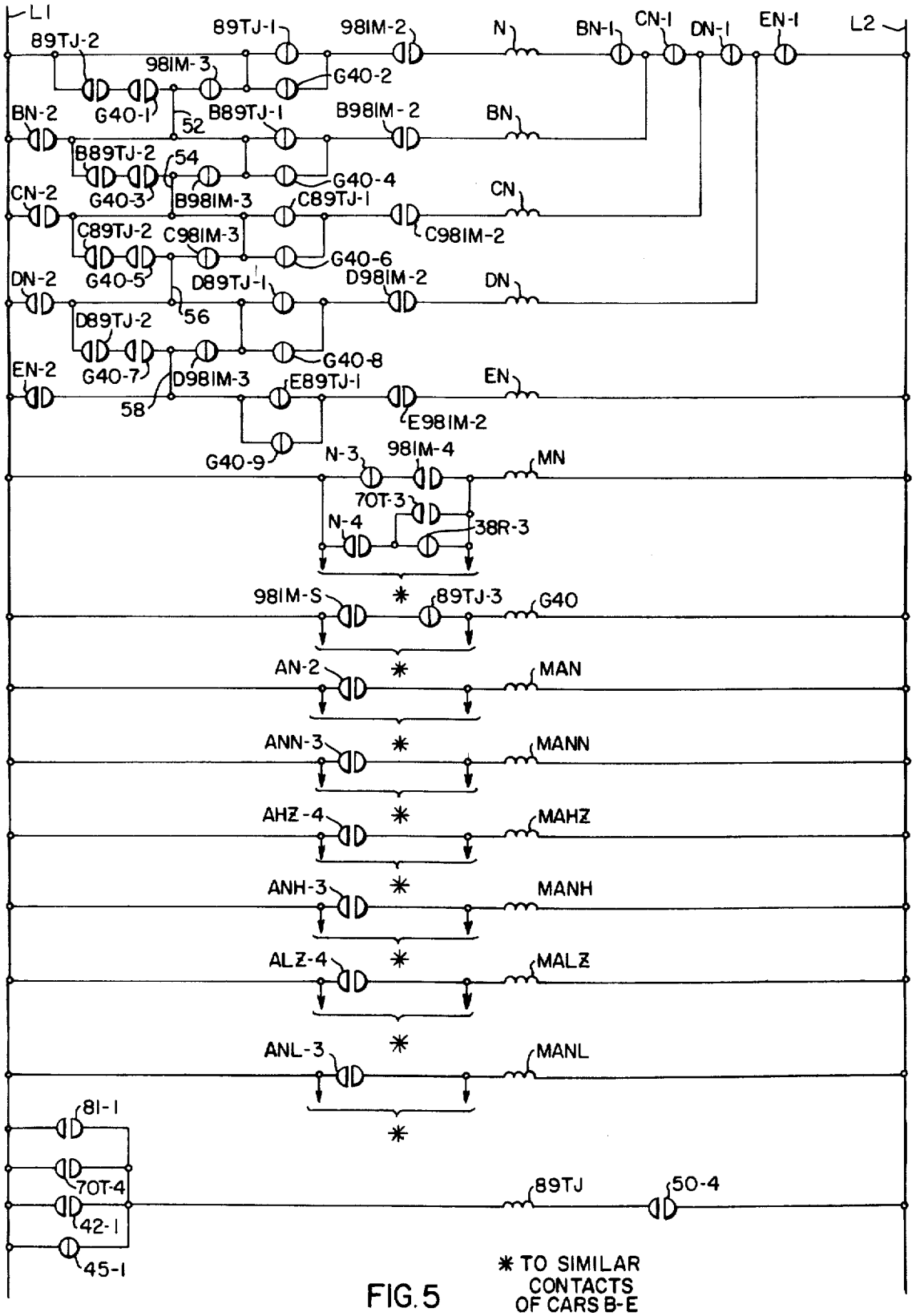

If some other car is already designated the first high zone available car, the contact AHZ-3 of the second car to become available in the zone will be closed and if no other car is designated the second high zone available car, the master relay MANH of FIG. 5 will be deenergized and the second high zone available car relay ANH of this second car to become available in the zone will pick up through contact MANH-1 and seal in with its ANH-1 contact. Contact ANH-2 isolates the ANH relays of cars having a lower letter designation in the alphabet, and contact ANH-3 in FIG. 5 picks up the master relay MANH which prevents any other car from picking up its ANH relay be virtue of contact MANH-1 opening.

When the first high zone available car receives an assignment, the ANH car, if any, becomes the ANZ car, unless another car is available in the zone with a higher letter designation, in which event the interlocking contacts AHZ-2, BAHZ-2, CAHZ-2 and DAHZ-2 pick the available car with the higher letter designation for the first high zone available car.

When the second low zone available car receives an assignment or it vacates an assignment level by moving to the first low zone available car assignment slot, an undesignated available car in the zone, if any, becomes the second low zone available car. If there is more than one undesignated available car in the zone when the second high zone available car level is vacated, the interlocking contacts ANH-2, BANH-2, CANH-2 and DANH-2 pick the available car with the higher letter designation in the alphabet for the second high zone available car.

FIG. 4 also illustrates relay AVBT which, when energized, enables the car to become available when at a basement level. Relay AVBT is energized when there is a demand in the system (indicated by contact MD-2 being closed) and some car has the NEXT assignment at the main floor indicated by contact MN-1 being closed.

FIG. 5 illustrates the master assignment level relays MANN, MAHZ, MANH, MALZ and MANL, already referred to when describing FIG. 4, the master NEXT relay MN, the master first NEXT available car relay MAN, the NEXT car relay N; the motor-generator shutdown timer 89TJ, and the G40 relay which indicates whether or not there is a car at the main floor with its motor-generator set running.

The master assignment level relays MANN, MAHZ, MANH, MALZ and MANL are responsive to the ANN, AHZ, ANH, ALZ and ANL relays, respectively, of all of the elevator cars, and pick up when some elevator car has the associated assignment level designation.

The master first NEXT available car relay MAN is responsive to the AN relays of all of the elevator cars, picking up when some car is designated the first NEXT available car.

The selection of the NEXT car, and the priority order in selecting a NEXT car when more than one car is eligible, is illustrated by the N relays of the various elevator cars, i.e. relays N. BN, CN, DN and EN.

Relay N for car A has one side of its electromagnetic coil connected to conductor L2 via the serially connected break contacts BN1, CN-1, DN-1 and EN-1 of the NEXT car relays. The other side of relay N is connected to conductor L1 via make contact 981M-2 and then through either break contact 89TJ-1, or break contact G40-2. Relays BN, CN, DN and EN are similarly connected to conductor L1 through other contacts of the 89TJ and G40 relays as well as contacts of their own 981M relays and N relays. They are each connected to conductor L2 through break contacts of the NEXT relays of the cars which have a lower letter designation in the alphabet. For example, relay BN is connected to conductor L2 via contacts CN-1, DN-1 and EN-1.

Figure 9:
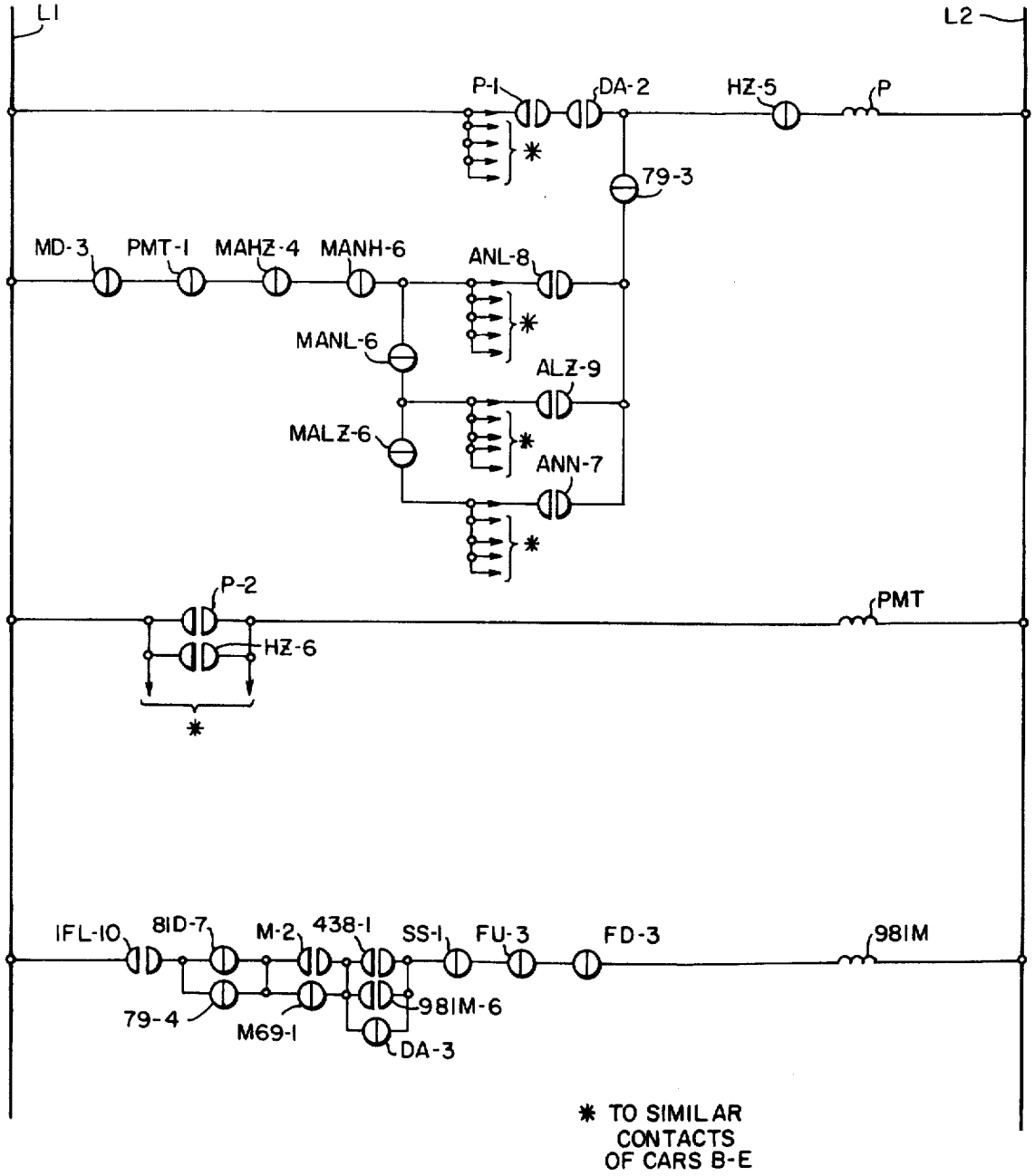

Relay 981M, shown in FIG. 9, indicates, when energized, that the elevator car is in-service and is located at the main floor, it is set for up travel, and it has no assignments. Relay 89TJ-1, shown in FIG. 5, is the motor-generator shut-down timer which, when energized, indicates the car is still busy and should not be considered for the NEXT assignment. If relay 89TJ is deenergized, it indicates the car is not busy and may be considered for the NEXT assignment. Relay 89TJ also starts a timer when it becomes deenergized, which timer shuts the motor-generator down if it times out before the car receives an assignment. Relay 89TJ is connected to conductor L2 via make contact 50-4 of the motor-generator starting relay 50 shown in FIG. 1. Relay 89TJ is connected to conductor L1 through any one of the following contacts, 81-1, 70T-4, 42-1 and 45-1. If running relay 81 is energized, it indicates the car still has calls, even though the elevator car may be stopped at a floor, and contact 81-1 is thus closed to energize relay 89TJ and remove it from consideration as the NEXT car. If relay 70T is energized the non-interference time is still timing out and thus the car is still "busy" and is not considered for the NEXT car. If relay 42 is energized, it indicates a command to an available car to open its doors, and thus the car is "busy". If relay 45 is deenergized, it indicates an "open door" command and thus the car is busy and is not considered as the NEXT car.

With the doors closed and no command to open the doors, relay 89TJ drops out. Break contact 89TJ-3, along with make contact 981M-5 control the operation of relay G40. When the elevator car is in service at the main floor with no assignment, contact 981M-5 is closed, and when the car is not "busy" as determined by relay 89TJ, contact 89TJ-3 will be closed and relay G40 will be energized.

An interlocking circuit between the NEXT relays of the elevator cars is formed by connecting additional contacts of the 89TJ, G40, N, and 981M relays as illustrated in FIG. 5. More specifically, the serially connected string of contacts 981M-3, G40-1 and 89TJ-2 have each end of the string connected to conductor L1. A similar serial string of contacts B981M-3, G40-3 and B89TJ-2 has both ends of the string connected to conductor L1 through make contact BN-2 of the NEXT car relay BN for car B. A conductor 52 is connected from the junction between contacts G40-1 and 981M-3 to the commonly connected ends of the serial string of contacts connected to contact BN-2. Similar circuits are formed in the circuits of relay CN and DN, with conductor 54 interconnecting the BN and CN circuits, conductor 56 interconnecting the CN and DN circuits, and conductor 58 interconnecting the DN and EN circuits.

If elevator car A, for example, is the only car at the main floor and is eligible for consideration as NEXT, relay 89TJ for car A will be deenergized, relay G40 will be energized to indicate there is at least one car at the main floor which qualifies for consideration as NEXT, and the next car relay N for car A will be energized.

If car C, for example, is the only car at the main floor, its CN relay will be energized through the circuit which includes:

L1, 981M-3, B981M-3, C891TJ-1, C981M-2, CN, DN-1, EN-1, L2

When CN picks up, it seals in via its contact CN-2 and stays energized until contact C981M-2 drops when elevator car C gets a signal to leave the main floor. Contact CN-1 opens to prevent the NEXT relays N and BN from being energized.

If there are two cars at the main floor eligible for the NEXT assignment, the car having the higher letter designation of the alphabet will be picked. For example, if cars B and C are the two cars which are at the main floor, relay CN cannot get a feed to conductor L1 because contact B981M will be open. Relay BN will be energized through the circuit which includes:

L1, 981M-3, B98TJ-1, B981M-2, BN, CN-1, DN-1, EN-1, L2

If a car is NEXT (contact N-4 closed) and it has no car call for a floor above the car (38R-3 closed), or the non-interference time is still timing (contact 70T-3 closed), the master next relay MN will be energized to indicate there is a NEXT car. If no car is NEXT (contact N-3 closed), but some car is in-service at the main floor (contact 981M-4 closed), the master next relay MN will also be energized, as there is no need to call a car to the main floor.

Figure 6:
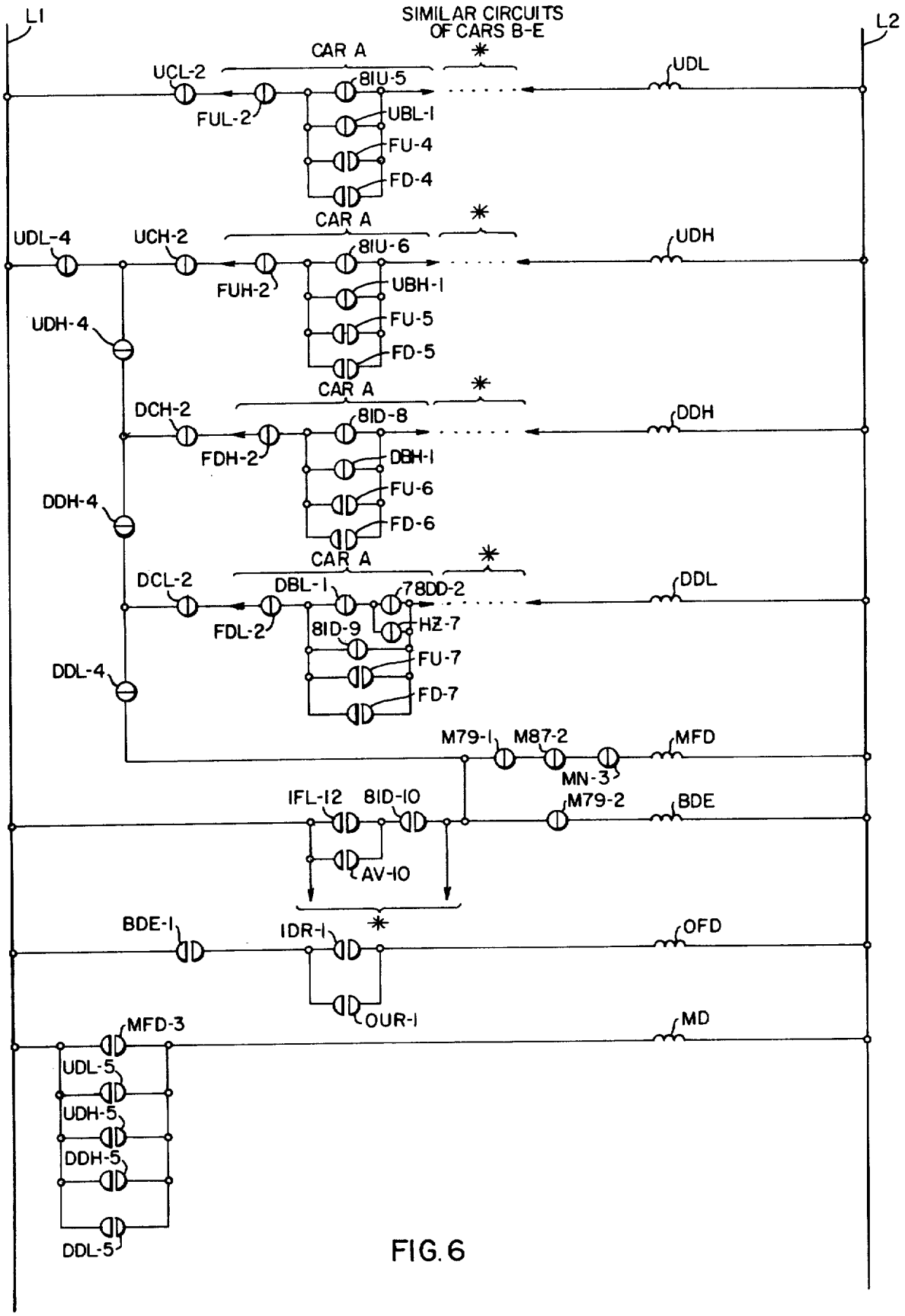

FIG. 6 illustrates the circuits which indicate the existence of a system demand, and the specific type of service demand which has been registered.

Figure 7:
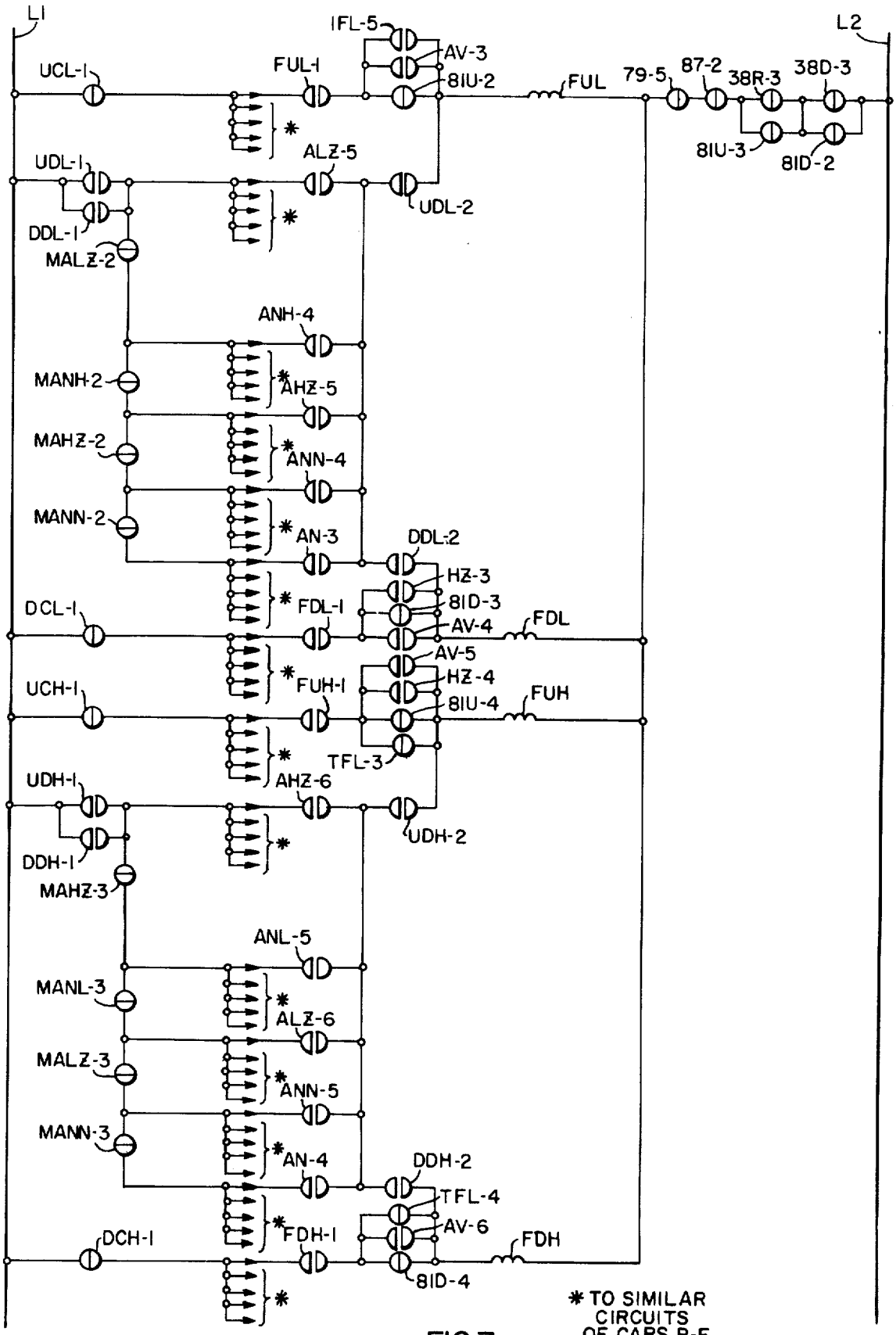

A low zone up demand exists if there is an up hall call in the low zone and there is no car traveling up in the low zone below the floor at which the call is registered in a position to answer it, and no car has been assigned to the call. An up demand in the low zone causes relay UDL to be energized. When a car is assigned to a low zone up demand, its FUL relay in FIG. 7 is energized.

A high zone up demand exists if there is an up hall call in the high zone and there is no car traveling up in the high zone below the floor at which the call is registered in a position to answer it, and no car has been assigned to the call. An up demand in the high zone causes relay UDH to be energized. When a car is assigned to a high zone up demand, its FUH relay in FIG. 7 is energized.

A high zone demand exists if there is a down hall call in the low zone and there is no car traveling down above the floor at which the call is registered in a position to answer it, and no car has been assigned to the call. A down demand in the high zone causes relay DDH to be energized. When a car is assigned to a high zone down demand, its FDH relay in FIG. 7 is energized.

A low zone down demand exists if there is a down hall call in the low zone and there is no car traveling down in the low zone above the floor at which the call is registered in a position to answer it, and no car has been assigned to the call. A low zone down demand causes relay DDL to be energized. When a car is assigned to a low zone down demand, its FDL relay in FIG. 7 is energized.

A main floor demand exists when there is no NEXT car and no car has been given a main floor or basement assignment. A main floor demand causes relay MFD to be energized.

A basement demand is enabled by relay BDE when it is energized. Relay BDE is energized when a car set for down travel is available, or is at the first floor, and no car has been given a basement assignment.

When a basement demand is enabled by relay BDE, a down hall call registered at the main floor or an up or down hall call registered from a basement level will pick up the basement demand relay OFD.

If any of the demand relays MFD, UDL, UDH, DDH or DDL pick up, the master demand relay MD is energized.

As illustrated in FIG. 6, the demand relays are interlocked to give a preference or priority to the demands in the following order: UDL, UDH, DDH, and DDL. If there are no high or low zone demands, then demands may be registered for the main floor zone, i.e. the main floor demand MFD and the basement demand OFD.

More specifically, an up hall call in the lower zone drops relay UCL and its contact UCL-2 closes to enable the circuitry for the up demand in the low zone relay UDL. Relay UDL will not be energized by this up call in the low zone if any car has been given a low zone up assignment, indicated by contact FUL-2 being open. Relay UDL will not be energized if any single car meets all of the following tests:

a. if it is set for up travel (contact 81U-5 is open)
b. the up hall call is ahead of the car (contact UBL-1 is open), and
c. the car has not been assigned to any demands (contacts FU-4 and FD-4 are open).

Thus, relay UDL will be energized to register a low zone up demand by the call if no car has been given a low zone up assignment and if each car fails one of the (a), (b) or (c) tests listed above. If relay UDL picks up to register a low zone by demand, its contact UDL-4 opens to disable the other demand relays, as the low zone up demand has the highest priority.

If there is no low zone up demand, contact UDL-4 will be closed, and if there is an up hall call in the high zone, contact UCH-2 will be closed to enable the high zone up demand relay UDH. Relay UDH will not be energized by this up hall call in the high zone if any car has been given a high zone up assignment, indicated by contact FUH-2 being open. Further, relay UDH will not be energized if any single car meets all of the following tests:

a. if it is set for up travel (contact 81U-6 open)
b. the up hall call is ahead of the car (contact UBH-1 is open), and
c. the car has not been assigned to any demands (contacts FU-5 and FD-5 are open).

Thus, relay UDH will be energized to register a low zone up demand by the up call in the high zone if no car has been given a high zone up assignment and if each car fails one of the (a), (b) or (c) tests listed above. If relay UDH picks up to register a high zone up demand, its contact UDH-4 opens to disable the lower priority demand relays DDH, DDL, BDE and MFD. Relay UDL is not disabled, and if a demand is registered in the low zone while a demand is registered in the high zone, contact UDL-4 will open to drop relay UDH.

If there is no low zone up or high zone up demand, a down hall call in the high zone will close contact DCH-2 to enable the high zone down demand relay DDH. Relay DDH will not be energized by this down hall call in the high zone if any car has been given a high zone down assignment (contact FDH-2 open). Further relay DDH will not be energized if any single car meets all of the following tests:

a. if it is set for down travel (contact 81D-8 open)
b. the down hall call is ahead of the car (contact DBH-1 is open), and
c. the car has not been assigned to any demands (contacts FU-6 and FD-6 are open).

Thus, relay DDH will be energized to register a high zone down demand by the down call in the high zone if no car has been given a high zone down assignment and if each car fails one of the (a), (b) or (c) tests listed above.

If relay DDH picks up to register a high zone down demand, its contact DDH-4 opens to disable the lower priority demand relays DDL, BDE and MFD. Relays UDL and UDH are not disabled. Thus, if an up demand is registered in either the high or the low zones, while a down demand is registered in the high zone, the UDL or UDH relay will pick up and drop out the DDH relay.

If there is no low zone up or high zone up demand, or high zone down demand, a down hall call in the low zone will close contact DCL-2 to enable the low zone down demand relay DDL. Relay DDL will not be energized by this down hall call in the low zone if any car has been given a low zone down assignment, indicated by contact FDL-2 being open. Further relay DDL will not be energized if any single car meets all of the following tests:

a. no down call behind the car in the low zone (concontact DBL-1 open) or contact DBL-1 is closed but the car is in the high zone (HZ-7 open) with no down calls ahead in the high zone (contact 78DD-2 open)
b. the car is set for down travel (contact 81D-9 open)
c. the car has not been assigned to any demands (contacts FU-7 and FD-7 open).

If relay DDL picks up to register a low zone down demand, its contact DDL-4 opens to disable demands for the main floor zone. Also, the registration of a higher priority demand will drop relay DDL.

If there are no up or down demands in the low or high zones, and no car has been assigned to the basement level or levels (contact M79-2 closed), the basement demand enable relay BDE will be energized. When relay BDE is energized it permits a basement demand to be registered by closing its contact BDE-1 in the circuit of the basement demand relay OFD. Now, relay OFD will be energized to register a basement demand if there is a down hall call registered at the main floor (1DR-1 closed) or there is an up hall call registered from the basement level (OUR-1 closed). If there is more than one basement level, each basement level would have a demand relay similar to OFD which would be enabled by a contact of the basement demand enable relay BDE. Also, if there is more than one basement level, a down hall call registered from a basement level will pick up the associated relay OFD when enabled by relay BDE.

The basement demand enable relay BDE may also be energized even though there is a low or high zone up or down demand, and no car has been given a basement assignment, if any car is set for down travel (contact 81D-10 closed) and the car is at the main floor (contact 1FL-12 closed) or, the car is available for assignment (contact AV-10 closed).

The main floor demand relay MFD is energized when there are no high or low zone up or down demands, no cars have been assigned to the basement or main floor (contacts M79-1 and M87-2 closed) and there is no car with a NEXT assignment (contact MN-3 closed).

Any high or low zone up or down demand, or a main floor demand, will pick up the master demand relay MD.

Figure 8:
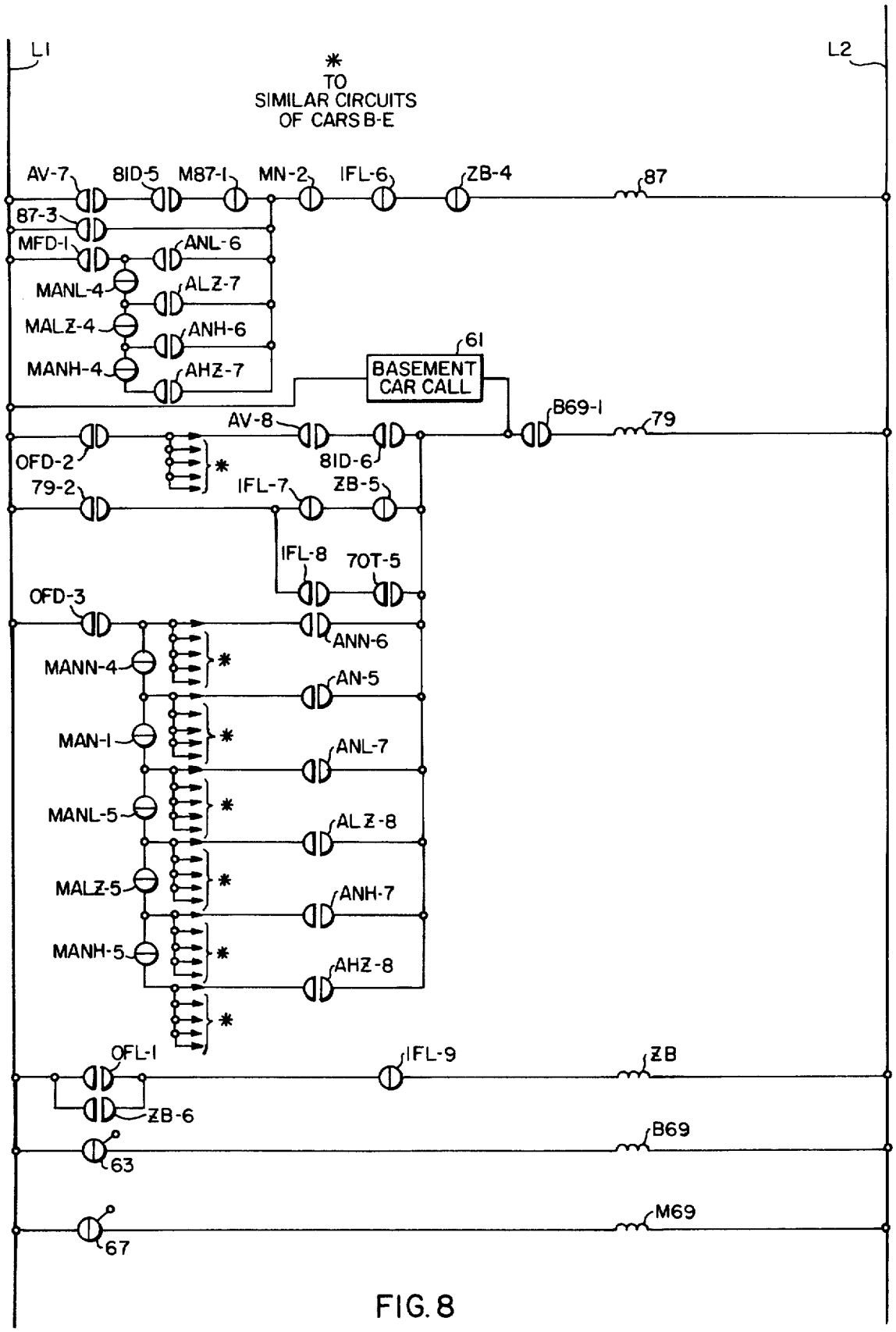

FIG. 7 illustrates the circuits which perform the functions of assigning elevator cars to up and down demands in the high and low zones. The circuits for relays FU and FD may be the same as illustrated in FIG. 8 of the second incorporated application and are not repeated here. The up and down assignment relays for the high and low zones are enabled if the car has no basement or main floor assignment (contacts 79-5 and 87-2 closed) and the car has no car call ahead when it is traveling down (contacts 38D-3 and 81U-3 closed) or the car has no car call ahead when traveling up (contacts 38R-3 ad 81D-2 closed). It will be remembered from FIG. 6 that only one high or low zone up or down demand can be registered at any one time, as the interlocking demand relay contacts automatically drop out a lower priority demand relay when a higher priority demand relay is energized. Thus, the demand assignment relays of FIG. 7 need no interlocking to select demands in the proper priority order. FIG. 7, as will be hereinafter explained, includes interlocking circuits to select available cars in a predetermined priority order from the graded assignment level designations when a demand is registered.

More specifically, if relay UDL picks up to register an up demand in the low zone, its contact UDL-1 closes to enable the low zone assignment relays, and its contact UDL-2 closes to enable the FUL relay of each car.

If any car is available in the low zone and it has the low zone assignment, as hereinbefore described relative to FIG. 4, its relay ALZ will be picked up and its ALZ-5 contact will be closed to energize its low zone up demand assignment relay FUL. When relay FUL picks up, it opens its contact FUL-2 in FIG. 6 to drop relay UDL and cancel the demand. If there is no first low zone available car, there will be no second low zone available car as a second low zone available car automatically becomes the first low zone available car when the first low zone available car assignment slot is vacated. If there is no first low zone available car, the master relay MALZ will be deenergized and its contact MALZ-2 will be closed to enable the available car slots of lower priority. The next highest priority is the second high zone available car, and if any car has this assignment its ANH relay will be energized and its contact ANH-4 will be closed to pick up relay FUL. If there is no second high zone available car, master relay MANH will be deenergized and its contact MANH-2 will be closed to pick a car having the first high zone assignment, if any. If a car does have a first high zone available car assignment, its AHZ-5 contact will be closed to pick up its FUL relay. If there is no first high zone available car, the master relay MAHZ will be deenergized and its contact MAHZ-2 will be closed to enable a car of the next priority level to be selected. This level is the second NEXT car at the main floor. If any car has the second NEXT available car assignment, its ANN relay will be energized and its ANN-4 contact will pick up relay FUL. If there is no second NEXT available car at the main floor, the master relay MANN will be deenergized and its contact MANN-2 will be closed to give the up demand in the low zone assignment to the first NEXT car, if any. If there is a first NEXT car, its AN relay will be energized and its contact AN-3 will be closed to pick up the FUL relay.

When relay FUL picks up, one of its make contacts picks up the up demand assignment relay FU and its contact FU-1 in FIG. 4 drops the available car relay AV for this car.

If the elevator car is standing at the floor of the up call which registers the demand, the stopping relay 438 picks up and its door relay 42 picks up to drop the 45 relay and initiate door opening. The 438, 42, and 45 relays are illustrated in the second incorporated patent.

If the car is located in the high zone when it receives the low zone up assignment, relay FUL will seal-in via its contact FUL-1 and contact 81U-2. Thus, the car will be "on assignment" and unable to answer hall calls until it reaches the lowest up call and the car reverses its travel direction, at which point contact 81U-2 opens to drop relay FUL. The car is now capable of traveling up in the low zone and it will answer up calls in the low zone which are ahead of its travel direction. A similar sequence is followed if the car is located in the low zone, but the demand is below the car.

If the car is in the low zone, below the demand when relay FUL picks up, the FU relay picks up to drop the AV relay and relay UBL picks up since the demand is above the car. A contact of relay UBL picks up the up preference relay 81U, and the running relay 81 picks up to start the car. Contact 81U-2 opens to drop relay FUL permitting the 438 stopping relay to stop the car for up calls ahead in the low zone.

If the demand is a low zone down demand, relay DDL will be energized and its contact DDL-1 in FIG. 7 will be closed to enable the low zone assignment relays. Its contact DDL-2 in each individual car circuit enables the low zone down demand assignment relays FDL of the cars. The interlocks of the master relays MALZ, MANH, MAHZ and MANN "look" at the assignment slots of the available cars in the same priority order as hereinbefore described relative to picking an available car for the low zone up demand, i.e. the first low zone available car (ALZ), the second high zone available car (ANH), the first high zone available car (AHZ), the second available NEXT car (ANN), and finally, the first available NEXT car (AN).

If the car with the FDL assignment is in the high zone, the FDL relay seals in via its contact FDL-1 and contact HZ-3 of the high zone relay HZ until the car enters the low zone at which point contact HZ-3 opens to drop relay FDL. If the car with the FDL assignment is in the low zone but below the floor of the demand, relay FDL seals in through its FDL-1 contact and contact 81D-3 of the down preference relay 81D. When the car reaches the highest down call in the low zone and relay 81D picks up to change the travel direction to down, relay FDL drops out.

If relay UDH picks to register an up demand in the high zone, its contact UDH-1 closes to enable the high zone assignment relays, and its contact UDH-2 closes to enable the FUH relay of each elevator car. If any car is available in the high zone and it has the high zone assignment, as hereinbefore described relative to FIG. 4, its AHZ relay will be picked up and its AHZ-6 contact will be closed to energize its high zone up demand assignment relay FUH. When relay FUH picks up it opens its contact FUH-2 in FIG. 6 to drop relay UDH and cancel the demand. If there is no first high zone available car, then there will be no second high zone available car as a second high zone available car would automatically become the first high zone available car when the first high zone available car assignment slot is vacated. If there is no first high zone available car the master relay MAHZ will be deenergized and its contact MAHZ-3 will be closed to enable lower priority available car slots. The next highest priority is the second low zone available car, and if any car has this designation, its ANL relay will be energized and its contact ANL-5 will be closed to pick up relay FUH. If there is no second low zone available car, master relay MANL will be deenergized and its contact MANL-3 will be closed to enable the next assignment level. This assignment level is the first low zone available car, and if a car has this assignment its ALZ relay will be energized and relay FUH will be picked up through contact ALZ-6. If there is no first low zone available car, the master relay MALZ will be deenergized and its contact MALZ-3 will enable the next priority level. This next level is the second NEXT car, and if any car has this assignment its ANN relay will be energized to pick up relay FUH through contact ANN-5. If there is no second NEXT car, the master relay MANN will be deenergized and its contact MANN-3 will be closed to energize the next priority level, which is the first NEXT car at the main floor. If any car has the first NEXT available car assignment, its AN relay will be energized and relay FUH will pick up through contact AN-4.

When relay FUH picks up, one of its make contacts picks up the up demand assignment relay FU and its contact FU-1 in FIG. 4 drops the available car relay AV for this car.

If the car is standing at the floor of the up call, the stopping relay 438 picks up and the door relay 42 picks up to drop the 45 relay and initiate door opening. If the car is located in the low zone when it receives the high zone up assignment, relay FUH will seal in via its contact FUH-1 and contact HZ-4. Thus, the car will be on assignment and unable to answer calls until it reaches the first floor of the high zone at which point contact HZ-4 will open to drop relay FUH. If the car is located in the high zone, but the demand is below the car, the FUH relay will seal in via its contact FUH-1 and contact 81U-4 until the elevator car reaches the lowest up call in the high zone, at which point contact 81U-4 opens to drop relay FUH.

If the elevator car is in the high zone below the floor of the demand when relay FUL picks up, the FU relay picks up to drop the AV relay UBH picks up since the demand is above the car. A contact of relay UBH picks up the up preference relay 81U, and the running relay 81 picks up to start the car. Contact 81U-4 opens to drop relay FUH permitting the 438 stopping relay to stop the car for up calls ahead in the high zone.

If the demand is a high zone down demand, relay DDH will be energized and its contact DDH-1 in FIG. 7 enables the high zone assignment relays. Its contact DDH-2 in the individual car circuits enables the high zone down demand assignment relay FDH of the cars. The interlocks of the master relays MAHZ, MANL, MALZ and MANN consider the assignment slots of the available cars in the same priority order as hereinbefore described relative to picking an available car for the high zone up demand, i.e. the first high zone available car (AHZ), the second low zone available car (ANL), the first low zone available car (ALZ), the second NEXT available car (ANN), and the first NEXT available car (AN).

If the car with the FDH assignment is in the low zone, the FDH relay seals in via its contact FDH-1 and contact 81D-4 until the car reaches the highest down demand in the high zone, at which point the travel direction changes and contact 81D-4 opens to drop relay FDH. The same contacts seal in relay FDH if the car is in the high zone but below the floor which registered the demand.

If the car is in the high zone above the floor of the demand when relay FDH picks up, the FD relay picks up to drop the AV relay and the DBH relay picks up since the demand is below the car. A contact of relay DBH picks up the down preference relay 81D, and the running relay 81 picks up to start the car. Contact 81D-4 opens to drop relay FDH, permitting the 438 stopping relay to stop the car for down calls ahead in the high zone.

FIG. 8 illustrates the circuits for performing the functions of selecting a car for main floor and basement demands, MFD and OFD, respectively. When the main floor demand relay MFD picks up to register a demand for the main floor, and there is no next car (contact MN-2 is closed) its contact MFD-1 in each car control closes to select an available car for assignment to the main floor. If there is a main floor demand and there is no NEXT car, there will be no in-service elevator cars at the main floor. The car selected for the main floor parking command will not be at the main floor (1FL-6 closed) and it will not be in the basement zone (contact ZB-4 closed).

The first available car assignment slot considered is the second low zone available car. If some car has this assignment slot, its contact ANL-6 will be closed and relay 87 will be energized. If there is no second low zone available car, the master relay MANL will be dropped out and its contact MANL-4 enables the first low zone available car to be selected, if any. If a car has the first low zone available car assignment slot its ALZ relay will be energized and contact ALZ-7 will be closed to pick up the 87 relay. If there is no second low zone available car and no first low zone available car, the master relays MANL and MALZ will both be deenergized and their contacts MANL-4 and MALZ-4 will be closed to enable the second high zone available car assignment slot to be considered. If some car is designated the second high zone available car its ANH relay will be energized and contact ANH-6 will be closed to energize the main floor assignment relay 87.

If there is no second low zone available car, no first low zone available car, and no second high zone available car, master relays, MANL, MALZ and MANH, respectively, will all be deenergized and their contacts MANL-4, MALZ-4 and MANH-4 will all be closed to enable the first high zone available car assignment slot to be considered. If some car has the first high zone available car assignment its AHZ relay will be energized and its contact AHZ-7 will be closed to energize relay 87.

When relay 87 picks up, it seals in via its contact 87-3 until a NEXT car is selected (MN-2 opens), or this car reaches the first floor (contact 1FL-6 opens) or, the basement zone (contact ZB-4 opens).

A car may also receive a main floor assignment if it is available (contact AV-7 closed) in the down direction (contact 81D-5 closed) and no other car has a main floor assignment (M87-1 closed).

Basement assignment or service relay 79 is energized when the car is not at the lowest floor level (contact B69-1 open) and the car has a car call for a basement level. The make contacts of the car cell relays for the basement levels are shown generally at 61. When relay 79 picks up, it seals in via its contact 79-2. If the car is at the first floor (contact 1FL-8 closed) with the non-interference time active (contact 70T-5 closed), relay 79 will drop when the non-interference time expires. If the car is not in the main floor zone, relay 79 will drop when the car enters the main floor zone (contact 1FL-7 or contact ZB-5 opens).

Relay 79 is also energized when there is a basement demand (contact OFD-2 closed) and the car is available (contact AV-8 closed) in the down direction (contact 81D-6 closed).

If a basement demand exists (contact OFD-3 closed) and there is no available car set for down travel a search is made of the various available car assignment slots, with a second NEXT available car having the highest priority. If some car is the second NEXT available car its ANN relay will be energized and contact ANN-6 will be closed to pick up relay 79.

If there is no second NEXT car, the master relay MANN will be deenergized, and its contact MANN-4 will enable the selection of a first NEXT available car for basement assignment. If some car has the first NEXT available car assignment slot, its AN relay will be energized and relay 79 will be energized via contact AN-5. If there is no first NEXT available car, the master relay MAN will be deenergized and its contact MAN-1 will enable a second low zone available car to be selected for the basement assignment. If some car has the second low zone available car assignment, its ANL relay will be energized and its contact ANL-7 will energize relay 79. If there is no second low zone available car, the master relay MANL will be deenergized and its contact MANL-5 will enable a first low zone available car to be selected for the basement assignment. If some car has the first low zone assignment slot, its ALZ relay will be energized and its contact ALZ-8 will energize relay 79. If there is no first low zone available car, the master relay MALZ will be deenergized and its contact MALZ-5 enables a second high zone available car to be selected for the basement assignment. If some car has the second high zone available car assignment, its ANH relay will be energized and its contact ANH-7 will pick up the 79 relay. If there is no second high zone available car, the master relay MANH will be deenergized and its contact MANH-5 will be closed to permit a car with a first high zone available car assignment to be selected for the basement. If some car has the first high zone available car assignment, its AHZ relay will be energized and its contact AHZ-8 will pick up the 79 basement relay.

The basement zone relay ZB picks up when the car arrives at the first basement level below the main floor OFL-1 closes) and it stays energized until the car returns to the main floor (contact 1FL-9 opens).

Relay B69 is energized except when the car is physically located at the lowest floor level (contact 63 opens when the car is at the lowest floor level to drop relay B69).

Relay M69 is energized except when the car is physically located at the main floor (contact 67 opens when the car is at the main floor to drop relay M69).

FIG. 9 illustrates the parking assignment relay P and master parking relay PMT. If the car is not in the high zone, its high zone relay HZ will be deenergized and its contact HZ-5 will be closed, and a car's parking relay P will be enabled. If there is no demand in the system (contact MD-3 closed), no car has a parking assignment (contact PMT-1 closed) and there is no first or second high zone available cars (contacts MAHZ-4 and MANH-6 closed, respectively), a search is made for an available car to send to park at the lowest floor of the high zone. The first priority is for the second low zone available car. If there is a second low zone available car, its relay ANL will be energized and contact ANL-8 will be closed to pick up relay P. If there is no second low zone available car, master relay MANL will be deenergized and its contact MANL-6 will be closed to look for a first zone available car. If some car is a first low zone available car, its ALZ relay will be energized and its contact ALZ-9 will be closed to energize relay P. If there is no first low zone available car, master relay MALZ will be deenergized and its contact MALZ-6 will be closed to look for a second NEXT available car. If there is a second NEXT available car, its ANN relay will be energized and its contact ANN-7 will be closed to energize the parking relay P.

If some car has a parking assignment, its relay P will be energized and contact P-2 will pick up the master park relay PMT. When the car reaches the high zone, contact HZ-6 of the high zone relay HZ for the car closes to seal in relay PMT, and contact HZ-5 opens to drop relay P. Relay PMT stays energized until the car leaves the high zone.

FIG. 9 illustrates the car in-service at the main floor relay 981M. Relay 981M is energized when the car is at the main floor (contact 1FL-10 and contact M69-1 closed), it has no assignments (contacts FU-3 and FD-3 closed), it does not have a main floor start signal (contact SS-1 closed), and the doors are open (DA-3 closed).

In summary, there has been disclosed a new and improved elevator system in which the supervisory system divides the floors of a building into a plurality of zones, and then assigns a plurality of assignment levels for available cars for each of the zones. Available cars, as they become available in a zone, assume the highest vacant assignment level in that zone. If the graded assignment levels of that zone are already filled by available cars, the car is simply an undesignated available car until a graded assignment level becomes vacant and it can assume the vacated assignment level. Assignments to demands for elevator service to available cars are only made to available cars which are in these graded assignment levels, with the order in considering the different assignment levels of the zones depending upon the nature of the demand.

I claim as my invention:

1. An elevator system, comprising:

a building having a plurality of floors, means dividing the floors of said building into at least first, second and third zones, at least four elevator cars, means mounting said elevator cars for movement in the building to serve the floors, call registering means for registering calls for elevator service, demand means for registering a plurality of demands for elevator service in response to predetermined conditions, availablity means conditioning each of the elevator cars in response to predetermined conditions to be available for assignment, means providing a plurality of graded assignment levels in each of said first, second and third zones, with an elevator car entering the highest vacant assignment level of the zone it is located in when it becomes available, and assignment means assigning available cars to demands registered by said demand means, with the available car assigned to each demand being selected in a predetermined order from available cars in the graded assignment levels of all of the zones, with the predetermined selection order being responsive to the specific demand.

2. The elevator system of claim 1 wherein the availability means conditions a car to become available for assignment only from a graded assignment level of the zone in which the car is located.

3. The elevator system of claim 1 wherein there are first and second graded assignment levels in each zone with only available cars which are in the first and second assignment levels being eligible for assignment by the assignment means, and wherein additional available cars in a zone receive a graded assignment level designation as the cars in the graded assignment levels are assigned to demands by the assignment means.

4. The elevator system of claim 1 including means responsive to the absence of elevator cars in a predetermined zone for moving an available car from another zone to the predetermined zone, with the available car being selected in a predetermined order from the available cars in the graded assignment levels of the zones.

5. The elevator system of claim 1 wherein there are five elevator cars, and wherein each zone includes two graded assignment levels eligible for assignment by the assignment means.

6. The elevator system of claim 1 wherein there are four elevator cars, and wherein each zone includes two graded assignment levels which are eligible for assignment by the assignment means.

7. The elevator system of claim 1 wherein the floors include a main floor, with the floors above the main floor being divided into high and low zones, and with the main floor and the floors below the main floor being a third zone, and wherein the demand means is conditioned to register a demand for service in the high zone, a demand for service in the low zone, a demand for service for the main floor, and a demand for service for any floor located below the main floor.

8. The elevator system of claim 7 wherein the assignment means selects an available car for a demand in the high zone from the first and second assignment levels of the zones in the following order:

a. the first assignment level of the high zone,
b. the second assignment level of the low zone,
c. the first assignment level of the low zone,
d. the second assignment level of the third zone, and
e. the first assignment level of the third zone.

9. The elevator system of claim 7 wherein the assignment means selects an available car for a demand in the low zone from the first and second assignment levels of the zones in the following order:

a. the first assignment level of the low zone,
b. the second assignment level of the high zone,
c. the first assignment level of the high zone,
d. the second assignment level of the third zone, and
e. the first assignment level of the third zone.

10. The elevator system of claim 7 wherein the assignment means selects an available car for a demand at the main floor from the first and second assignment levels of the zones in the following order:

a. the second assignment level of the low zone,
b. the first assignment level of the low zone,
c. the second assignment level of the high zone, and
d. the first assignment level of the high zone.

11. The elevator system of claim 7 wherein the assignment means selects an available car for a demand for a floor located below the main floor from the first and second assignment levels of the zones in the following order:

a. the second assignment level of the third zone,
b. the first assignment level of the third zone,
c. the second assignment level of the low zone,
d. the first assignment level of the low zone,
e. the second assignment level of the high zone, and
f. the first assignment level of the high zone.

* * * * *